US005163206A

United States Patent [19]

Hernandez

[11] Patent Number: 5,163,206

[45] Date of Patent: Nov. 17, 1992

[54] SHEAR SAVER

[76] Inventor: Eva Hernandez, 1902 S. 47th Ave., Yakima, Wash. 98903

[21] Appl. No.: 730,492

[22] Filed: Jul. 16, 1991

[51] Int. Cl.[5] ..... A44B 21/00

[52] U.S. Cl. ..... 24/299; 24/300; 24/3 A; 24/3 M

[58] Field of Search ..... 24/299, 298, 300, 301, 24/302, 3 R, 3 M, 3 A

[56] References Cited

U.S. PATENT DOCUMENTS

| | | | |
|---|---|---|---|
| 792,677 | 6/1905 | Stowell | 24/299 X |
| 1,032,401 | 7/1912 | Hager | 24/300 X |
| 2,079,046 | 5/1937 | Schoeninger | 24/299 X |
| 2,879,990 | 3/1959 | Eaton | 24/302 X |

FOREIGN PATENT DOCUMENTS

| | | | |
|---|---|---|---|
| 196116 | 4/1923 | United Kingdom | 24/3 R |
| 299187 | 10/1928 | United Kingdom | 24/298 |

*Primary Examiner*—Victor N. Sakran
*Attorney, Agent, or Firm*—George A. Cashman

[57] ABSTRACT

A device for arresting the fall of a hand-held implement, such as hair shears, in case the operator drops them accidentally, comprises a finger ring, a short flexible connector attached to the finger ring, and a spring ring or sister hook attached to the free end of the connector for attachment to the hand-held implement. The short arrested fall prevents possible bodily injury, and avoids damage to the shears because they cannot fall on the floor.

4 Claims, 2 Drawing Sheets

SHEAR SAVER

BACKGROUND OF THE INVENTION

Field of the Invention

When using implements held by and manipulated by the fingers of one hand, such as hair-cutting shears, it occasionally happens that the user will drop the implement. If the implement is hair-cutting shears, for example, the shears may cause bodily injury when dropped, particularly if the shears are in an open position. Additionally, in the case of professional hair-cutting shears, the relationship of the blades to each other is highly precise. If the shears drop directly to the floor, they may be damaged beyond repair, because the relationship of the blades to each other may be altered. Such professional shears are expensive, often costing several hundred dollars per pair.

SUMMARY OF THE INVENTION

A finger ring has smaller ring, or padeye, attached to the outside periphery of the ring. A flexible connector, such as a jewelry-type chain, for example, has a spring ring or sister hook or similar attachment means at each end thereof. A first end of the connector is attached to the smaller ring, or padeye. The second end of the connector is attached to the ring-shaped portion of one of the handles of the shears. The second end may instead be attached to the shank between the ring-shaped portion and the pivot point of the shears.

It is an object of this invention to arrest the fall of the pair of shears if the operator drops them while cutting hair. Allowing the shears to fall only a short distance serves two purposes. Arresting the fall of the shears prevents possible bodily injury to the operator and to the person whose hair is being cut. Preventing the shears from falling to the floor saves the operator considerable money because it will not be necessary to have the shears repaired or to replace them.

DESCRIPTION OF THE PREFERRED EMBODIMENT(S)

Figure 1:
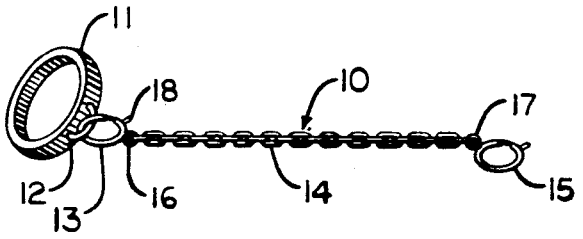
FIG. 1 illustrates the invention including a finger ring and a connector having attachment means at each end thereof.

Referring to FIG. 1 the shear save 10 comprises a finger ring 11 having smaller ring 12 attached to, and extending outward from the outer periphery of ring 11. A spring ring 13, which is a standard commercially available jewelry item, is attached to smaller ring 12. Spring ring 13 has projection 18 which may be moved peripherally to open a gap in spring ring 13. When a segment of spring ring 13 is placed within padeye 12, projection 18 may be released to close the gap, thereby securing spring ring 13 to smaller ring 12. Spring ring 13 is attached to a first end 16 of connector 14 which, in the referred embodiment, is a chain. Spring ring 15, which is identical to spring ring 13, is attached to second end 17 of connector 14.

A spring ring is a hollow toroidal metal part forming an arc of about 300°. One of the ends of the hollow toroidal ring is closed. A spring is inserted into the hollow torus, and a rod having the curvature of the torus is inserted into the torus where it rests against the spring. The spring urges the rod around the open part of the arc, where the rod rests against the closed end of the torus, closing the circle. An outward projection from the rod enables the user to open and close the spring ring.

Figure 2:
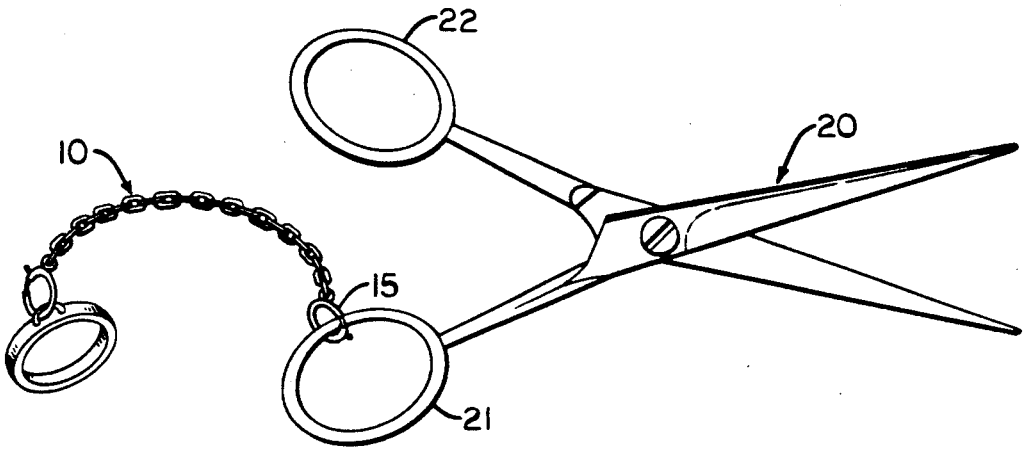
FIG. 2 illustrates the invention attached to one of the ring-shaped portions of a handle of a pair of shears.

Referring to FIG. 2, a pair of shears 20 has ring-shaped portion 21 at the end of one handle thereof, and ring-shaped portion 22 at the end of the outer handle thereof. Spring ring 15 is shown attached to ring-shaped portion 21.

Figure 3:
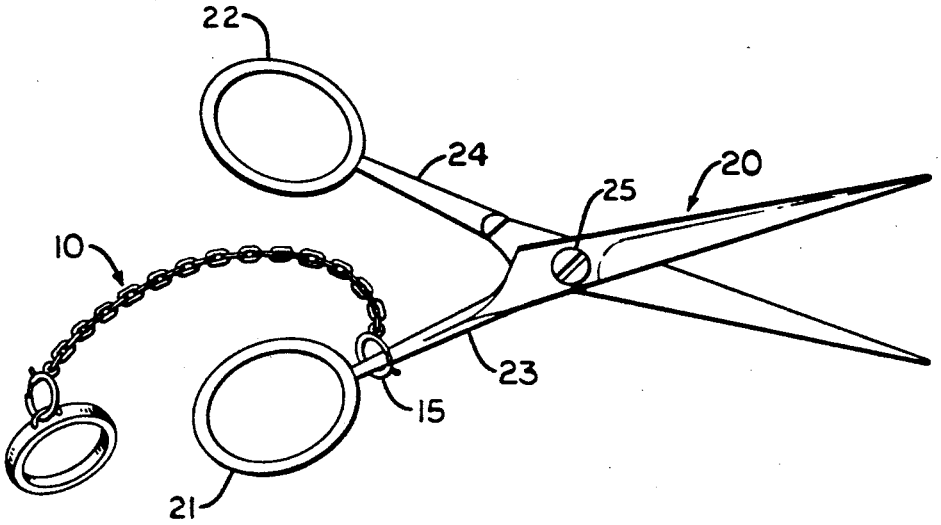
FIG. 3 illustrates the invention attached to the shank portion of a handle of a pair of shears.

Referring to FIG. 3, shears 20 has a shank 23 between ring-shaped handle portion 21 and pivot 25. Shears 20 also has shank 24 between ring-shaped portion 22 and pivot 25. Spring ring 15 is shown attached to shank 23. Spring ring 15 may be attached to either shank 23 or shank 24.

Figure 4:
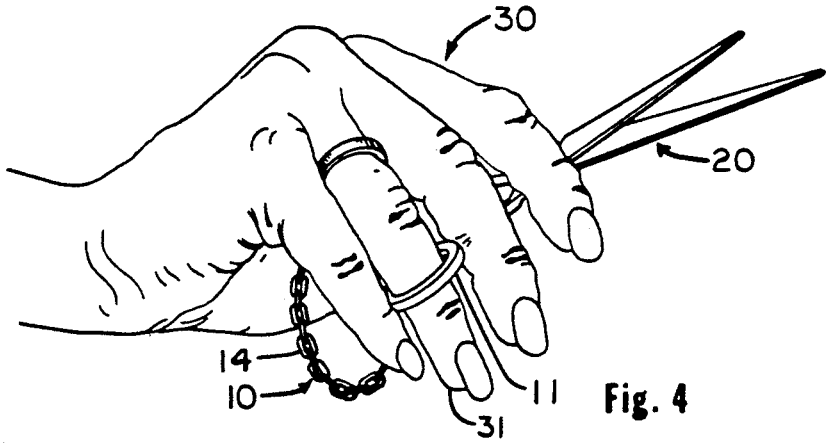
FIG. 4 illustrates the invention in use with the ring placed on the operator's fourth finger.

The shear save in use is illustrated in FIG. 4. Ring 11 is shown in position on one of the operator's fingers 31 of hand 30. The illustration shows ring 11 on the fourth finger, commonly called the ring finger, but the operator may place ring 11 on any finger, depending on personal preference. The length of connector 14 is sufficient to enable the operator to open and close the shears while experiencing no restriction from connector 14.

Figure 5:
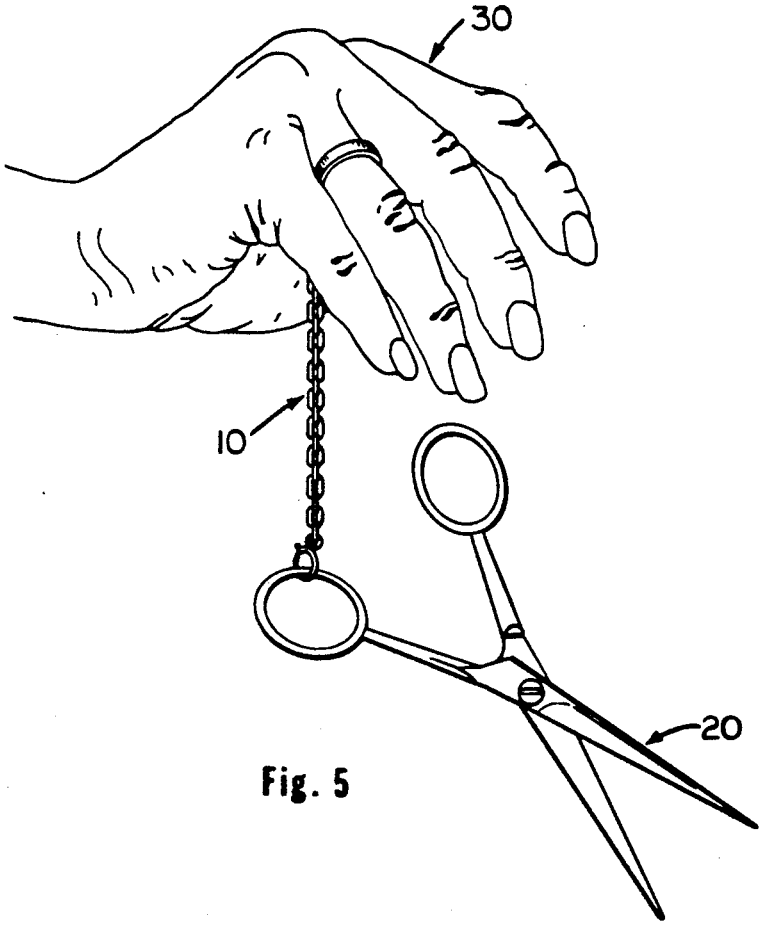
FIG. 5 illustrates the extend of travel of the shears if dropped by the operator.

Shears 20 are shown in FIG. 5 as they would appear if the operator had allowed them to slip from his or her hand 30. It can be seen that the shears 20 would drop only a short distance, not enough to cause bodily injury, and certainly not enough to fall to the floor and become damaged.

Figure 6:
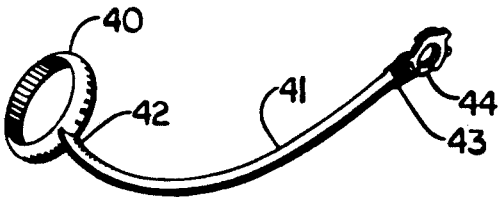
FIG. 6 illustrates a second embodiment of the invention including a ring, a connector and a sister hook.

Ring 11 may be made of any suitable material such as an alloy of gold, silver, platinum or any precious metal, and may also be made of a steel or copper alloy. The ring and connector may also be made of plastic as illustrated in FIG. 6, which shows ring 40 and connector 41. A first end 42 of connector 41 is attached directly to ring 40. Second end 43 of connector 41 has sister hook 44 attached thereto. Sister hook 44 may be attached to shears 20 as illustrated in FIGS. 2 and 3.

A sister hook is an oppositely disposed pair of hooks which overlay each other, and rotate around a common axis on the shanks of the hooks. The surface of the hooks which are in contact with each other are flat, so that when the sister hook is closed it forms a ring. The hook is opened and closed by means of a small projection on each hook. When the projections are moved apart, the hook is opened for attachment to an object. When the projections are moved closer to each other, the hooks overlie each other, and the retaining ring is complete.

It will be recognized that ring 11 or ring 40 may be decorated or ornamented in any manner without departing from the spirit of this invention. Connector 14 and connector 41 may be made of any flexible lightweight material without departing from the spirit of this invention.

The invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms of modifications within the proper scope of the claims appropriately interpreted in accordance with the doctrine of equivalents.

I claim:

1. A securing device and hand-held hair shears implement comprising:

an endless finger ring to be secured to an operator's hand, and having a smaller ring extending in the same plane from the periphery of said finger ring;

a one-piece flexible connector having a first end and a second end, said first end having means removably attached to said smaller ring, wherein said flexible connector allows free movement of all fingers of said operator's hand;

said second end having a spring ring means removably secured to said hand-held hair shears implement.

2. The securing device of claim 1 wherein the means for attachment of said flexible connector to said smaller rings are sister hooks.

3. The securing device of claim 1 wherein the finger ring is manufactured of a metal alloy.

4. The securing device of claim 1 wherein:

said finger ring and flexible extension being manufactured from a single piece of plastic.

* * * * *